United States Patent [19]

Sato

[11] 4,095,524

[45] Jun. 20, 1978

[54] INK SUPPLY MECHANISM FOR DICHROMIC PORTABLE LABELING MACHINE

[75] Inventor: Yo Sato, Tokyo, Japan

[73] Assignee: Kabushiki Kaisha Sato Kenkyusho, Tokyo, Japan

[21] Appl. No.: 772,469

[22] Filed: Feb. 28, 1977

[30] Foreign Application Priority Data

Mar. 6, 1976 Japan ..... 51-23724

[51] Int. Cl.[2] ..... B41J 27/12; B41J 27/14; B41F 1/46

[52] U.S. Cl. ..... 101/103; 101/196; 101/205; 101/291; 156/384

[58] Field of Search ..... 156/384, 385, 386–388; 101/95, 97, 98, 99, 82, 83, 202, 205, 209, 291, 193, 196, 197, 198, 199, 335, 338, 348, 288, 292, 293, 295, 327, 333, 334, 324–326, 103–105, 106, 108

[56] References Cited

U.S. PATENT DOCUMENTS

| | | | |
|---|---|---|---|
| 1,291,057 | 1/1919 | Marks | 101/103 |
| 3,551,251 | 12/1970 | Sato et al. | 156/384 |
| 3,878,783 | 4/1975 | Hamisch, Jr. | 101/348 |

*Primary Examiner*—J. Reed Fisher

*Attorney, Agent, or Firm*—Ostrolenk, Faber, Gerb & Soffen

[57] ABSTRACT

A dichromic ink supply mechanism for use in a hand operated labeler which prints labels dichromically: the ink supply mechanism comprises holding means pivotally attached to a manual actuating lever, two inking rollers respectively impregnated with inks of different colors and both being rotatably and removably carried on the holding means, and guide passages in the frame of the labeler for guiding reciprocating motion of the holding means and the rollers.

19 Claims, 6 Drawing Figures

10
11
12
13
14
15
16
17
17a
17b
18a
18b
19
21
22
23
24
25
26
27
28
38
49
53
64
68
69
71
73
74
75
76
77
78
79
81
82
83
84
85
86
87
88
89
91
92
93
94
95

INK SUPPLY MECHANISM FOR DICHROMIC PORTABLE LABELING MACHINE

FIELD OF THE INVENTION

The present invention relates to an ink supply mechanism for a portable label printing and applying machine, and particularly one which prints in different colors.

BACKGROUND OF THE INVENTION AND DESCRIPTION OF THE PRIOR ART

Dichromic printing by a portable label printing and applying machine or hand labeler and by a portable tagging machine is known. In one hand labeler, a pair of printing members are fixed to yokes which are pivotable up and down by actuation of a hand lever. A pair of independently rotatable arms are disposed in front of and at the back of those printing members. These arms independently and rotatably hold two inking rollers impregnated with different color inks. The rotating arms are pivotally connected to the frame of the hand labeler and are biased by a spring.

When the yokes are lowered by gripping of a hand lever, the front and rear printing members move downward and simultaneously push the front and rear inking rollers respectively frontward and rearward at the respective lower edges of the printing members. This rolls the inking rollers over the printing surfaces, which are formed at the lower edges of the front and rear printing members, and the printing surfaces are inked in different colors. The front inking roller is rolled over the printing surface of the front printing member, while the rear inking roller is rolled over the printing surface of the rear printing member. When the hand lever is further gripped, the yokes are lowered so that the printing surfaces abut the label, thus effecting dichromic printing.

However, the conventional ink supply mechanism has several drawbacks. Because the rotating arms holding the front and rear inking rollers are arranged at separate positions, the rotating arm for the rear inking roller must be attached to a center portion of the inside of the hand labeler. As a result, the hand labeler is so large in size that it cannot be handled with ease. Also, to enable replacement of an exhausted rear inking roller, more complicated means for removably attaching the rotating arm of that roller are required and this makes it difficult to handle the hand lever.

Moreover, the inking rollers are pushed into contact with the printing surfaces by the biasing force of a spring. This pushing force reduces as the spring is weakened due to its aging. The intensity of the inking declines so that the print on the label is not clear. This drawback becomes serious especially when the labels being printed are machine read, which requires precision printing.

Further, the printing surfaces should press more deeply into the surfaces of the inking rollers as the biasing force of the spring becomes weaker. But, because this does not occur, the ink which is trapped deep in the center portions of the inking rollers will not be pumped to the surfaces of the inking rollers by the pressure of the printing surfaces. As a result, only the ink that is stored near the surfaces of the inking rollers can be utilized. Thus, a set of inking rollers can imprint only a small number of labels, thereby making the label printing process uneconomical.

Finally, when the hand lever is squeezed rapidly, the inking rollers may jump and thereby avoid contacting the printing surfaces or only weakly contact these surfaces. This may prevent the label from being printed or may lead to shading of the inked imprints on the dichromically printed label.

Previous ink supply mechanisms are also shown in U.S. Application Ser. No. 716,934, filed Aug. 23, 1976 by the inventor hereof. But, these mechanisms generally have their inking rollers ink all of the printing surfaces. No effort is made to have each roller only ink a printing surface which prints one respective color.

SUMMARY OF THE INVENTION

It is, therefore, the major object of the present invention to provide an ink supply mechanism for use in a portable label printing and applying machine, which mechanism is free from any of the above drawbacks of the prior art.

A further object of the invention is to ink different printing surfaces in different colors.

Another object of the present invention is to provide an ink supply mechanism which includes a pair of inking rollers of different colors in an integrated assembly so as to minimize the space to be occupied by the front and rear rotating arms and the corresponding inking rollers.

Still another object is to provide such an ink supply mechanism which is reduced in size and weight.

A further object is to provide such an ink supply mechanism, in which the inking rollers and their holding members can be mounted and removed quite easily so that replacement of the inking rollers and maintenance of their parts can be accomplished promptly.

A further object is to provide such an ink supply mechanism, which can maintain the pushing force of the respective inking rollers on the front and rear printing members at a suitable constant level, so that ink which might otherwise be left unused at the center of the inking rollers, will be pumped to their surfaces.

The present invention concerns an ink supply mechanism of dichromic type for use in a portable label printing and applying machine. The labeler includes a machine frame, a manually actuated lever which is attached, preferably pivotally, to the machine frame, and a printing head including two printing members having type characters on their respective printing surfaces and carried on the actuating lever. The actuating lever and printing head are normally biased to a stand-by position. They are shifted to an inking position, at which the printing surfaces are supplied ink of different colors. They are further shifted to a printing position at which the inked printing surfaces print the selected type characters upon a label then at the print position.

The ink supply mechanism of the labeler comprises holding means pivotally attached to the actuating lever, two inking rollers, preferably impregnated with inks of different colors, and rotatably and removably carried on the holding means, and guide means including guide passage means formed in the machine frame for guiding the reciprocating motions of the holding means. The guide means includes two pairs of guide rollers, with each pair being located at both ends of one inking roller and being attached to the holding means. The guide rollers are slidably received in guide passages in the frame. The guide passages space the inking rollers a predetermined distance from the printing surfaces of the printing head when the actuating lever is released and the printing head is in the stand-by position. The guide passages guide the inking rollers to roll upon their respective printing surfaces of the printing head, as the actuating lever is manually actuated to about the middle of its stroke and the printing head is in the inked position. The guide passages finally guide the inking rollers into a refuge position apart from the printing surfaces of the printing head as the actuating lever is manually actuated through its full stroke and the printing head is in the printing position. The guide passage for the roller closest to the actuating lever includes a downwardly and forwardly inclined escape pathway which swings the rear roller down and forward after it has inked the rear printing surface, such motion of the rear roller being provided to avoid the rear roller inking the front printing surface.

BRIEF DESCRIPTION OF THE DRAWINGS

Other objects and features of the present invention will become apparent from the following description taken in conjunction with the accompanying drawings, in which.

DESCRIPTION OF THE PREFERRED EMBODIMENT

Figure 1:
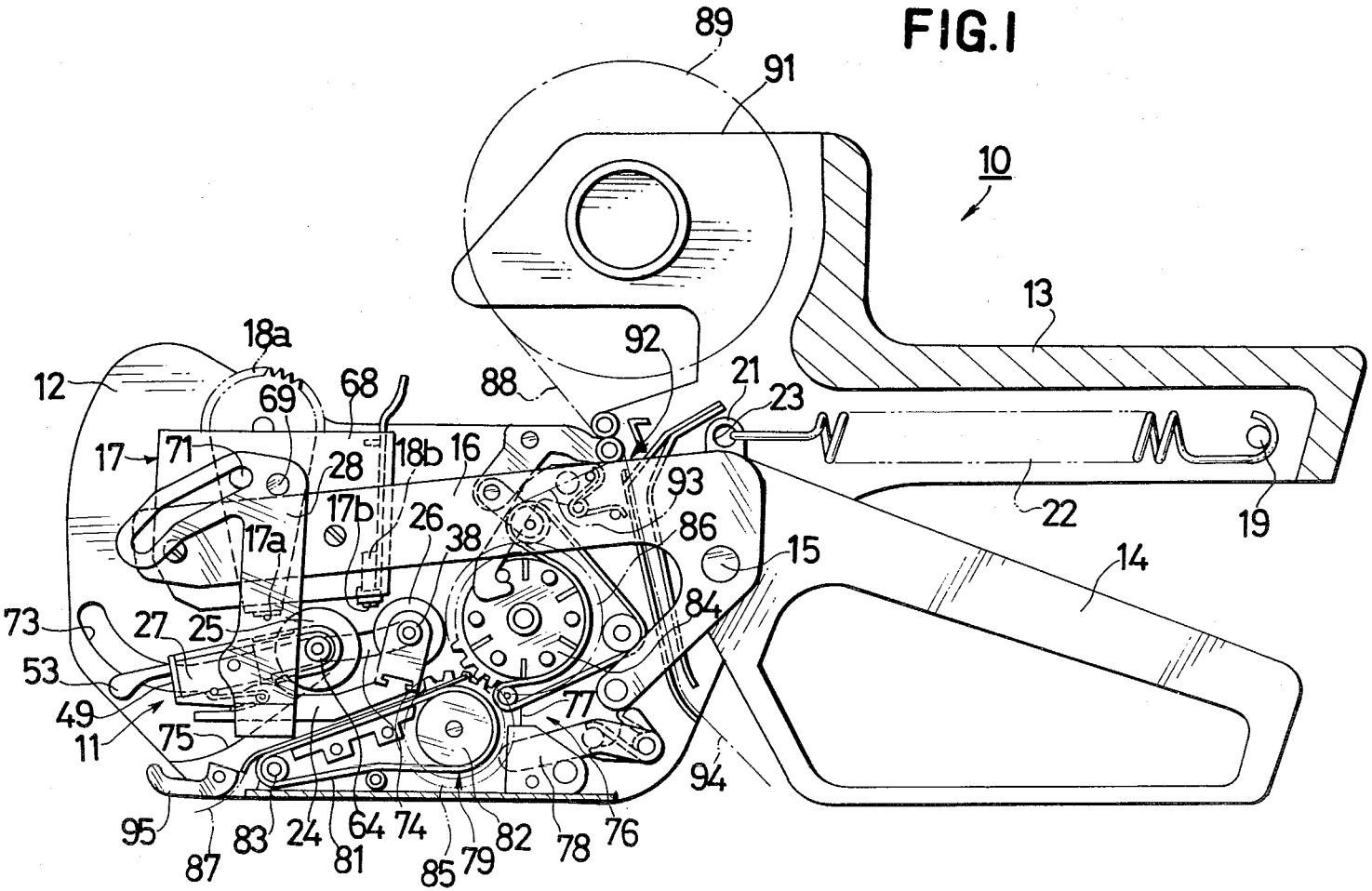
FIG. 1 is a side elevational view, with the near side frame removed, of a portable label printing and applying machine, which includes the ink supply mechanism according to the present invention and with the printing head in a stand-by position.

FIG. 1 shows a portable label printing and applying machine or hand labeler 10, into which an ink supply mechanism 11 according to the present invention is incorporated. The labeler 10 is comprised of a pair of machine frames 12. The rear (right in FIG. 1) portions of the frames form an integral grip 13. A manually actuable lever 14 is pivotally connected between the machine frames 12 by a support shaft 15.

The front portion of the hand lever 14 is formed into a pair of identical, parallel, but spaced apart yokes 16 which have a bifurcated shape. A printing head 17 is fixedly secured to the leading ends of the yokes 16. Printing head 17 is comprised of two somewhat spaced apart printing members **18*a* and 18*b*. A spring receiving pin 19 is disposed inside of the grip 13**.

A spring projection 21 is integral with the hand lever 14. A tensioned drive spring 22 extends between a hole 23 formed in the projection 21 and the spring pin 19. Spring 22 always biases the yokes 16 and the hand lever 14 to turn clockwise about the support shaft 15.

Figure 4:
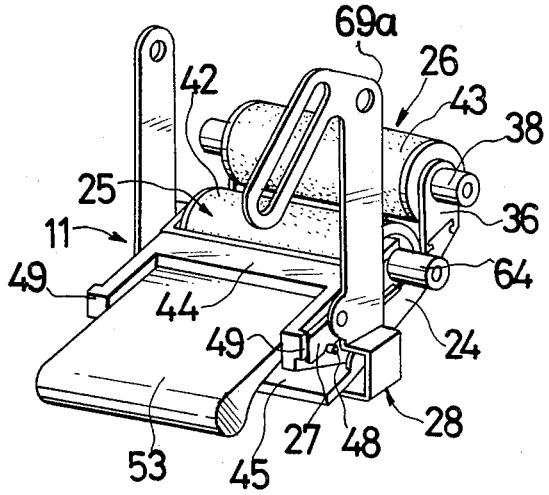
FIG. 4 is a perspective view showing a portion of the ink supply mechanism of the invention.
Figure 5:
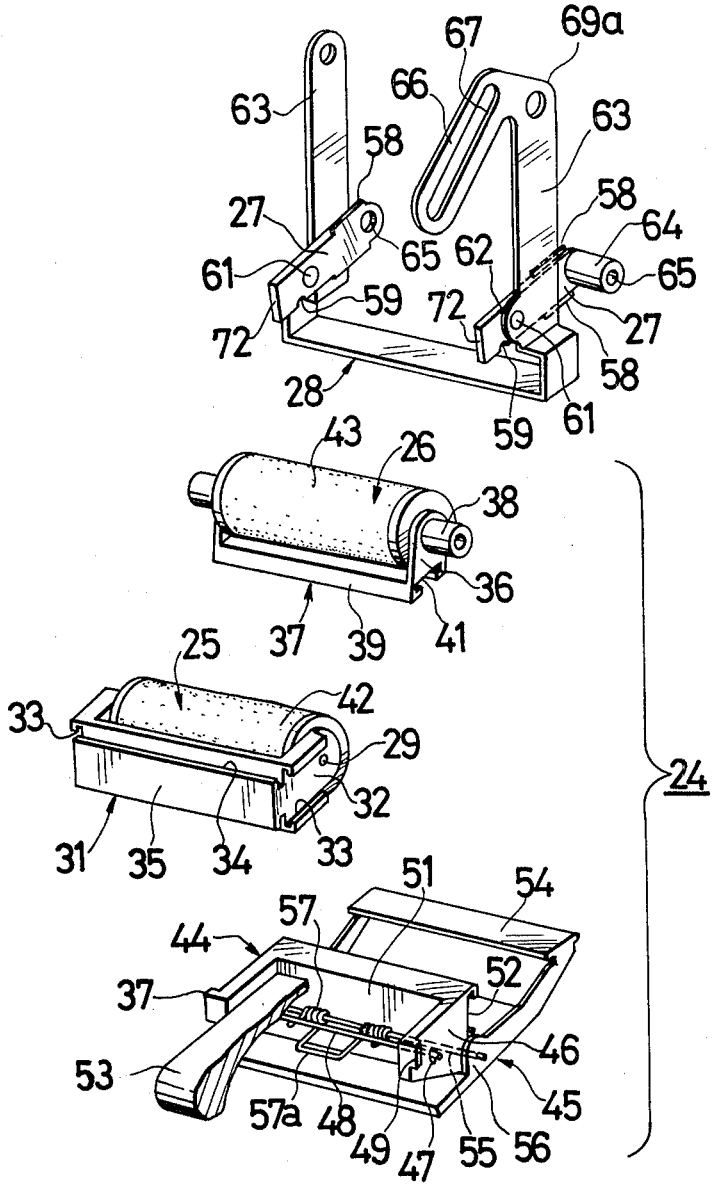
FIG. 5 is an exploded perspective view showing the assembly and parts of the ink supply mechanism.

Referring to FIGS. 4 and 5, the ink supply mechanism 11 according to the present invention is comprised of an ink roller assembly 24 having two inking rollers 25 and 26, a pair of holding members 27 and a rotating support arm 28. The ink roller assembly 24 holds the front inking roller 25 and the rear inking roller 26 and is removably attached as a whole to the holding members 27.

The front inking roller 25 is on a shaft. Both ends of the shaft project beyond the inking roller body and are rotatably fitted in bores 29. Bores 29 are formed in a cartridge frame 31, so that inking roller 25 may be rotatably attached to its frame 31. The body of the cartridge frame 31 is "C" shaped, including side leg portions 32 joined by a connecting web portion 35. The bores 29 are formed in both side leg portions 32. There are outwardly facing "C" shaped retaining portions 33 at the outer surfaces of the leg portions 32. There is a protruding, longitudinally extending engagement portion 34 at the outer side of the connecting portion 35.

The rear inking roller 26 is also on a shaft. Both ends of this shaft rotatably fit in bores (not shown), which are formed in the leg portions 36 of a cartridge frame 37. The cartridge frame 37 is also "C" shaped having side leg portions 36 joined by a connecting web portion 39. Guide rollers 38 are fixed on the outer surfaces of both leg portions 36. The guide rollers 38 may alternatively be rotatably mounted on the leg portions 36. Connecting portion 39 of the cartridge frame 37 has a "C" shaped, outwardly facing, longitudinally extending retaining portion 41 on its lower surface.

The front and rear inking rollers 25 and 26 support respective ink impregnated roller bodies 42 and 43, which may be impregnated with inks of different colors, such as black and red.

The cartridge frames 31 and 37 are removably attachable to their respective frame holders 44 and 45. The frame holder 44 is located in the upper front position. It has a "C" shape with leg portions 46. The leg portions 46 have vertically elongated bores 47, into which a pin 48 is inserted, as further described below. Stoppers 49 project from the forward ends of the leg portions 46. The connecting web portion 51 of frame holder 44 has a "C" shaped retaining portion 52 formed on its outer surface. The generally "T" shaped engagement portion 34 of the cartridge frame 31 is engageable with the retaining portion 52 by being slid sideways into it. A frame holder moving lever 53 is fixed in a recess formed between the leg portions 46 of the "C" shaped frame holder 44.

The other frame holder 45 is located in a lower rear position with respect to frame holder 44. The upper surface of the rear end of frame holder 45 has a protruding generally "T" shaped engagement portion 54, which is engageable with the "C" shaped retaining portion 41 of the cartridge frame 37 by being slid into it. At a front portion of the frame holder 45, there is a pin 55 which extends between upstanding side plates 56 of holder 45. This pin 55 also passes through pin bores, which are formed at lower end portions of the leg portions 46 of the frame holder 44. A spring 57 is wound on the pin 55. Both end portions of this spring abut against the lower surface of the pin 48, while the center actuating portion **57*a* of the spring abuts against the upper surface of the bottom plate of the frame holder 45. As a result, the frame holders 44 and 45 are pivotally supported together by the pin 55, and the holder 45 is biased to turn counterclockwise about the pin 55 by the spring 57**.

The holding members 27 are formed on their respective upper and lower surfaces with projections 58. The front portions of the lower ends of members 27 have retaining notches 59 which have a semicircular cross-section. The "C" shaped retaining portions 33 of the cartridge frame 31 are slid into and are retained on the projections 58. Both ends of the pin 48 are retained in the retaining notches.

The holding members 27 have their leading end portions pivotally connected by pins 61 to the protruding portions 62 of the side plates 63 of the rotating arm 28. At the rear end portions of the holding members 27 a pair of guide rollers 64 are rotatably mounted by pins 65.

Figure 2:
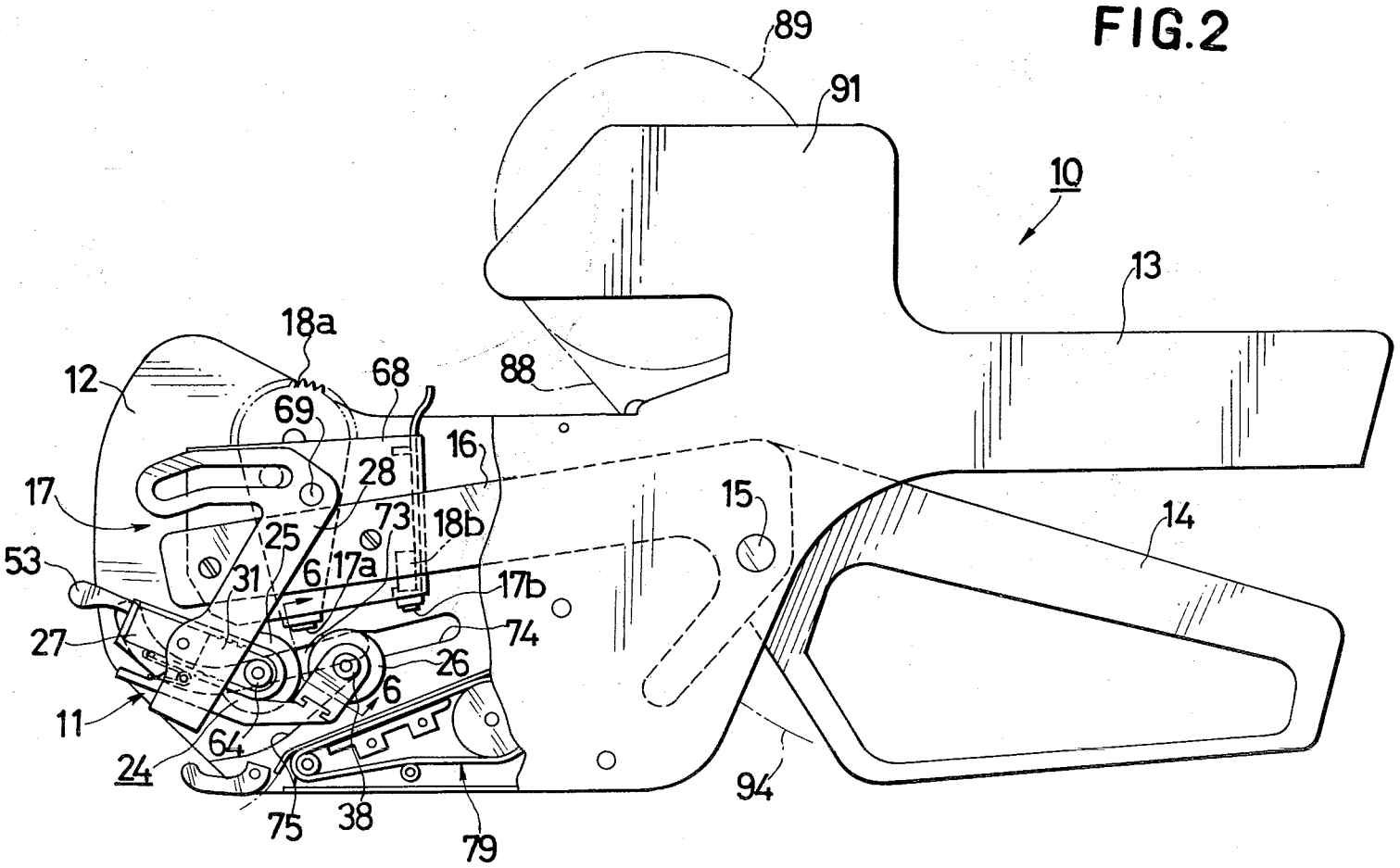
FIG. 2 is a simplified version of the view of FIG. 1, in which the printing head is in position to be inked.

The rotating support arm 28 is generally of a "U" shape. The upper end of one of its side plates 63 merges into a forwardly extending portion 66 that has a slot 67 which extends obliquely downward and forward. The upper ends of the side plates 63 of the rotating arm 28 are pivotally connected to the printing head frames 68 of the yokes 16 by means of pins 69 which pass through openings 69*a* in arm 28, as shown in FIGS. 1 and 2. As has already been described, to the protruding portions 62 formed in the front surfaces of the lower portions of the side plates 56, there are pivotally connected the leading end portions of the holding members 27 by means of the pins 61. A guide pin 71, which is formed in the inside surface of the machine frame 12 engages in the slot 67, as shown in FIG. 1, so that as pin 69 and slot 67 pivot, they pivot around pin 71.

The protruding engagement portion 34 of the cartridge frame 31 in the ink roller assembly 24 slidingly engages the "C" shaped retaining portion 52 of the frame holder 44. The "C" shaped retaining portion 41 of the cartridge frame 37 slidingly receives the protruding engagement portion 54 of the frame holder 45, thus integrating the cartridge frame 31 with the frame holder 44 and the cartridge frame 37 with the frame holder 45, thereby to constitute the integrated ink roller assembly 24.

The assembly 24 is removably attached to the holding members 27 which, in turn, are pivotally attached to the rotating arm 28. The "C" shaped retaining portions 33 of the cartridge frame 31 are slidingly received on the projections 58, which are formed on the upper and lower end surfaces of the holding members 27 and the retaining portions 33 are pushed until the front ends 72 of the holding members 27 abut against the stoppers 49 of the frame holder 44. In this way, attachment of the assembly 24 to the rotating arm 28 is completed.

FIG. 4 shows the ink roller assembly 24 attached to the rotating arm 28. In this condition, moreover, the pin 48, which is attached to the frame holder 44, has both of its ends held in the retaining notches 59 of the holding members 27.

In order to remove the ink roller assembly 24 from the holding members 27, the forward end of the lever 53 is simultaneously pulled forward (to the left of FIG. 4) and pushed downward. Then, the pin 48 is removed from the retaining notches 59 of the holding members 27. Pulling the lever 53 forward releases the ink roller assembly 24 from its engagement, as the "C" shaped retaining portions 33 of the cartridge frame 31 slide off the outer surfaces of the projections 58 of the holding members 27. The assembly 24 is thus removed from the holding members 27 and from the rotating arm 28.

When the ink supply of one of the front or rear inking rollers 25, 26 is exhausted, the assembly 24 is removed from the holding members 27. Then, the respective cartridge frame 31 or 37 is removed from the respective frame holder 44 or 45, and the cartridge holder carrying the exhausted inking roller 25 or 26 is discarded. A new inking roller is attached to the cartridge frame 31 or 37, and this frame is incorporated into the frame holder 44 or 45 so as to reconstitute the assembly 24, which is then remounted in the holding members 27.

Figure 6:
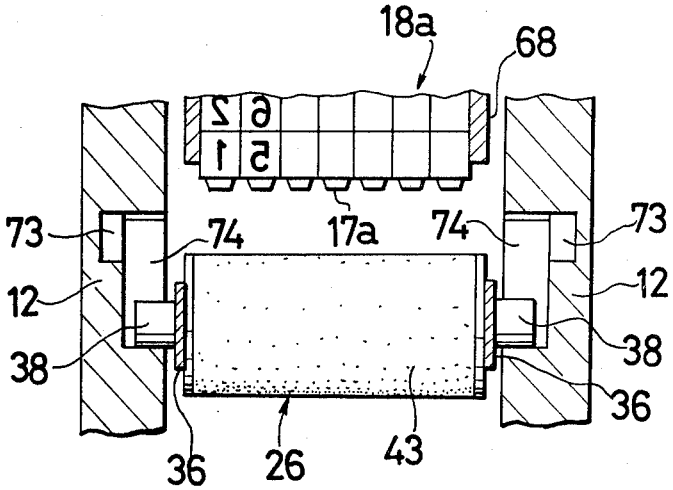
FIG. 6 is an enlarged cross-sectional view taken along the line and in the direction of arrows 6—6 of FIG. 2.

As shown in FIG. 1 to 3 and 6, a pair of front guide grooves 73 and a pair of rear guide grooves 74 are both formed in the inside walls of the machine frames 12. The front guide grooves 73 are cut deeper into the inside walls of the frames 12 than the rear grooves 74 as can be seen in FIG. 6. The front grooves have their front end portions curved upward. The frontmost guide rollers 64 of the holding members 27 engage in the front grooves 73 and are slidable therealong. The rear guide grooves 74 include escape surfaces 75, which are steeply inclined downwardly and forwardly from the rear end portions of the front guide grooves 73, so that the rear guide rollers 38 of the cartridge frame 37 may roll along the rear grooves 74.

The axial distance between the guide rollers 64 is larger than that distance between the guide rollers 38 to correspond with the front guide grooves 73 being deeper than the rear guide grooves 74.

A label cutting mechanism 76 of a type known to those skilled in the art is shown in FIG. 1. Mechanism 76 includes a cutting blade 77 which is movably held in a blade support 78.

There is a known type of label feed mechanism 79 which includes a belt 81 treated with silicone and which runs between a larger rear roller 82 and a smaller front roller 83. The motion of the label feed mechanism 79 is coordinated with that of a feed roller 84 of the cutting mechanism 76 by gear mechanisms 85 and 86, again as is known to those in the art.

The operation of the ink supply mechanism 11 is now described. Referring to FIG. 1, the printing head 17 is normally biased clockwise by the drive spring 22 to a standby, upraised position when the hand lever 14 is released. As shown in FIG. 2, when the hand lever 14 is gripped to the midway point of its stroke toward the grip 13, the yokes 16 are rotated counterclockwise and downward about the support shaft 15. The printing head 17 is brought into position to be inked and the rotating arm 28 is rotated clockwise about the pin 69. The ink roller assembly 24, which is attached to the holding members 27 connected pivotally to the rotating arm 28, will move forward during the clockwise rotation of the arm 28.

The front and rear inking rollers 25 and 26 roll under a regulated and constant pressure upon the respective printing surfaces 17*a* and 17*b* of the printing heads 17 and supply ink thereto. This occurs because the guide rollers 64 attached to the holder member 27 are guided forward in the front guide grooves 73 while the guide rollers 38 attached to the cartridge frame 37 are guided forward in the rear guide grooves 74.

Because the respective inking rollers 25 and 26 push against the printing surfaces 17*a* and 17*b* at all times under suitable pressure without being located excessively close to or apart from the printing surfaces 17*a* and 17*b*, the ink impregnated spongy roller bodies 42 and 43 can rotate with their surfaces being depressed by the printing surfaces 17*a* and 17*b*. Moreover, the ink which might otherwise be left in the center portions of the roller bodies 42 and 43 is automatically pumped to the outer peripheries of the respective inking rollers 25 and 26 by the restoration of the depressions formed in the roller bodies 42 and 43.

As described before, the rear guide grooves 74 are formed with the downwardly inclined escape surfaces 75. As shown in FIG. 2, the lower surfaces of the "C" shaped retaining portions 33 of the cartridge frame 31 are brought into abutment with the upper surfaces of the side plates 56 of the frame holder 45 so as to push the holder down. When, therefore, the inking rollers 25 and 26 are allowed to move forward more, the guide rollers 38 are lowered along the escape surfaces 75 with the resultant downward movement of the rear inking roller 26. Thus, the rear inking roller 26 will not contact the front printing surface 17*a* but will only contact the rear printing surface 17*b*.

Figure 3:
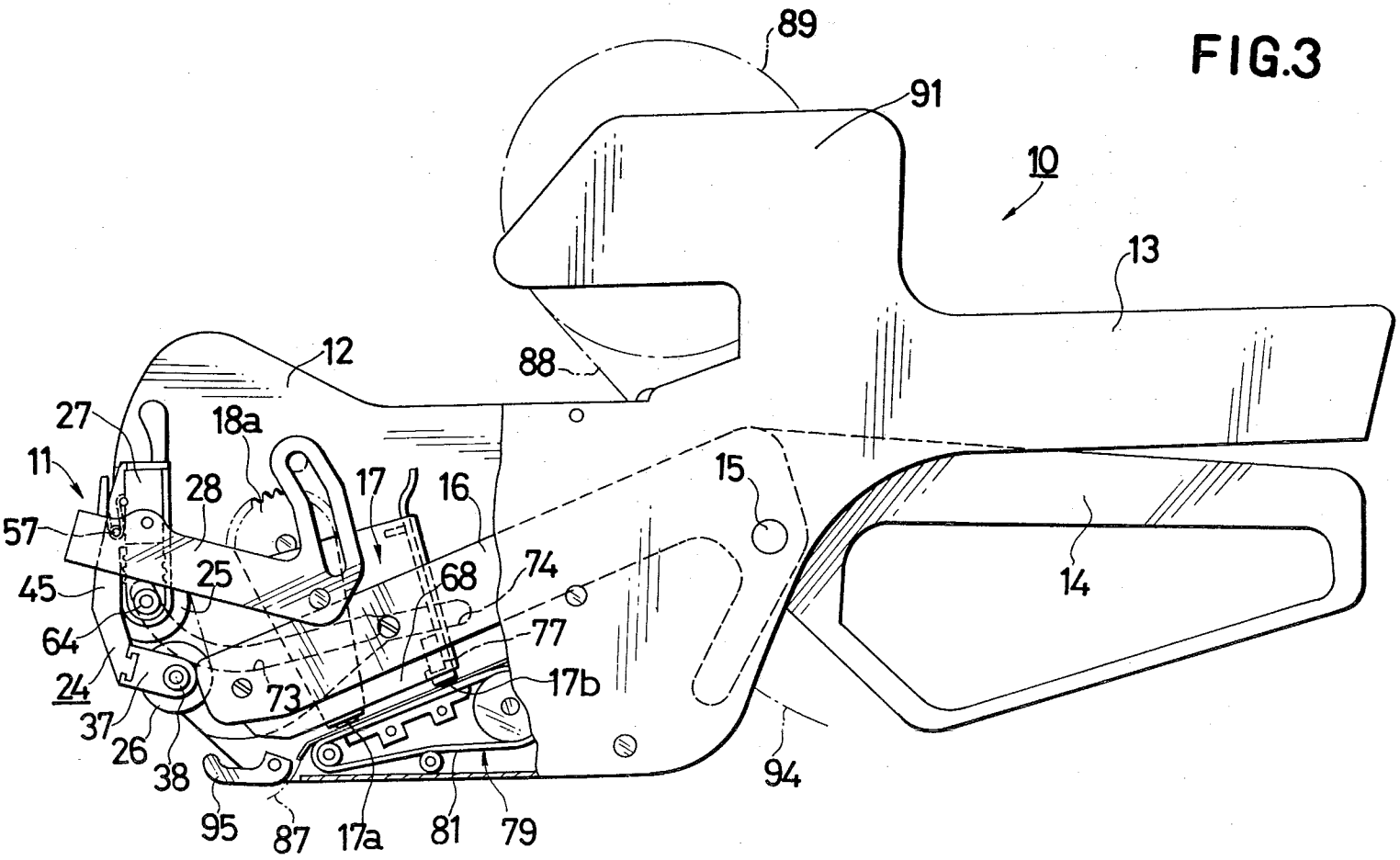
FIG. 3 is a similar view to FIG. 2, in which the printing head is in a label printing position.

When the hand lever 14 is gripped to its full stroke, the inking rollers 25 and 26 are moved forward, as shown in FIG. 3, to such an extent that they are disengaged from the lower surfaces of the printing head frames 68. As a result, the front inking roller 25 rests along the front guide grooves 73 while the rear inking roller 26 is disengaged from the escape surfaces 75 of the rear guide grooves 74, until the two rollers 25 and 26 stop in a refuge position apart from the printing surfaces 17*a* and 17*b*.

The frame holder 45 is rotated forward through the machine frames 12. But it does not obstruct label applying because label holder 45 is biased counterclockwise by the spring 57. The printing members 18*a* and 18*b* are lowered to bring their printing surfaces 17*a* and 17*b* to abut a label 87, which is placed upon the belt 81 of the label feed mechanism 79, thereby to imprint the label.

Referring to FIG. 1, a continuous label strip 88 is fed out from a roll 89 that is held rotatably between upper arm shaped side plates 91 of the labeler 10. The strip 88 is divided at a peeling portion 92 into a strip of labels 93 and a strip of backing paper 94. The label strip 93 is fed to the cutting mechanism 76, which cuts individual labels 87 of a predetermined length by the action of the cutting blade 77 in response to the upward motion of the hand lever 14. The single cut label is fed onto the belt 81 in response to the return motion of the drive spring 22 and the hand lever 14.

Upon return motion of the hand lever 14, the yokes 16 are moved upward by the drive spring 22. The rotating arm 28 causes the opposite action to that effected during hand lever gripping. The ink roller assembly 24 also retracts to the right in FIG. 1 to return to its original condition after having passed through the condition of FIG. 2, while the guide rollers 64 and 38 return along the guide grooves 73 and 74.

During the releasing of the hand lever, the label feed mechanism 79 which is connected by known means to the hand lever 14 advances the belt 81 a predetermined distance. The printed label 87 is fed out to the underside of a label applying member 95, and at the same time, the next cut label 87 is fed below the printing head 17.

Although guide grooves 73 and 74 are illustrated as the guide means for the guide rollers 64 and 38, the guide means need not thus be limited, and other suitable guiding means, such as guide rails, could be used.

As noted above, many advantages can be obtained with the present invention.

Since a pair of inking rollers impregnated with different color inks are held in an integral assembly, the ink supply mechanism of the present invention requires less space than the conventional ink supply mechanism, thus enabling the size of the hand labeler as a whole to be minimized.

Since the paired inking rollers are integrated and held in the assembly, the diameters and thus the volume of the inking rollers can be accordingly enlarged so that the inking rollers can be used for a prolonged time period. This reduces the wasted time previously spent in frequent ink roller replacements.

As the assembly holding the paired inking rollers can be incorporated in the labeler and removed therefrom with ease and since the inking rollers can also be emplaced and removed with ease, replacement of the inking rollers and maintenance of their parts can be accomplished easily and promptly.

Since the ink impregnated bodies of the inking rollers about the printing surfaces under a regulated constant pressure, the quantity of ink supplied to the printing surfaces is always maintained at a constant level, thus making it possible to print the label with high precision.

Because the ink stored at the surface and the center portions of the ink impregnated rollers can be fully consumed, the ink supply mechanism of the present invention makes it possible to print a greater number of labels than the conventional ink supply mechanisms, thus providing an economical hand labeler.

Even if the hand lever is gripped or released rapidly, the difference in shading or darkness of the printed labels can be maintained at a minimum level.

With the foregoing advantages in mind, the ink supply mechanism according to the present invention can find an application in a hand labeler, which can, for example, print a shop name and a price of a commodity in different colors. This is useful for a small scale shop that has previously suffered from the inconvenience that it could not have its name printed upon a label because the size of its order of rolls of label strip was small. The ink supply mechanism can also be used in a hand labeler which is used to print information, for example, bar codes for an optical read-out system or OCR characters, which requires high precision printing processes.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A portable label printing and applying machine, comprising:

a machine frame; an actuating lever movable with respect to said frame;

a printing head including at least a first and a second printing member with a respective first and second printing surface thereon and having type characters on said printing surface; said printing head being attached to and being movable with said actuating lever; means normally biasing said printing head to a standby position; said actuating lever being movable to move said printing head from said standby position to an inking position at which said printing surfaces are inked by inking rollers pressing against said printing surfaces with a predetermined pressure and being further movable by said actuating lever to a printing position at which said printing surfaces contact a label to imprint it;

an ink supply mechanism comprising:

holding means pivotally attached to said actuating lever for moving said holding means with respect to said frame as said actuating lever moves; at least a first and a second inking roller rotatably carried on said holding means so as to be rotatable with respect to said holding means and said first inking roller being rotatable over said first printing surface and said second inking roller being rotatable over said second printing surface;

a first guide in said frame for guiding motion of said first inking roller; a second guide in said frame for guiding motion of said second inking roller;

first and second guide engaging means located at said first and second rollers, respectively, and connected for movement therewith; said first and said second guide engaging means slidably engaging and being slidable along said first and said second guides, respectively;

said guides and said printing surfaces being so positioned and shaped that said inking rollers are spaced from said printing surfaces when said printing head is in said standby position, such that said each of first and second printing surfaces are engaged by the respective one of first and second inking rollers when said actuating lever has been manually actuated partially through its stroke and such that said inking rollers are moved out of the pathway of said printing head when said actuating lever is moved through its full stroke and said printing surfaces are moved to imprint a label and further wherein said guides are shaped to cause said second inking roller to move away from said printing surfaces after said second inking roller contacts said second printing surface, thereby to prevent said second inking roller from contacting said first printing surface.

2. The label printing and applying mechanism of claim 1, wherein said first guide and said first inking roller are further from said actuating lever than said second guide and said second inking roller, respectively; said first and said second guides extending along said frame generally transversely to the path of motion of said printing head.

3. The label printing and applying mechanism of claim 2, wherein said second guide further comprises an escape passage inclined downwardly in the direction of motion of said printing head toward the printing position and being inclined forwardly which is in the direction of motion of said second inking roller with said holder as said printing head is moving toward the print position and is in the direction in which said printing head first passes said second printing surface and thereafter passes said first printing surface, and the inclination of said escape passage is for enabling said second inking roller to move down more extensively than said first inking roller as said holding means moves forwardly through said frame, thereby also enabling said second inking roller to avoid contacting said first printing surface.

4. The label printing and applying mechanism of claim 1, wherein said first inking roller is impregnated with ink of one color and said second inking roller is impregnated with ink of another color.

5. The label printing and applying mechanism of claim 4, wherein said first guide and said first inking roller are further from said actuating lever than said second guide and said second inking roller, respectively; said first and said second guides extending along said frame generally transversely to the path of motion of said printing head.

6. The label printing and applying mechanism of claim 4, wherein said inking rollers are removably attached on said holding means.

7. The label printing and applying mechanism of claim 6, wherein said holding means further comprises:

said holding means holds said inking rollers to move in the same general direction through the respective said guide engaging means;

a pivot on said yoke; pivotable linkage means which is pivotally attached to said yoke at said yoke pivot so as to move with said yoke as said actuating lever is operated and so as to pivot with respect to said yoke around said yoke pivot as said actuating lever is operated;

a first fixedly located engagement element on said machine frame; a second engagement element on said linking means and in engagement with said first engagement element on said machine frame, such that as said yoke moves and said first and said second engagement elements remain in engagement, said holding means is pivoted rapidly around said yoke pivot, thereby to move said inking rollers out of the way of motion of said printing head toward the print position.

8. The label printing and applying mechanism of claim 7, wherein said first and second engagement elements are further from said actuating lever than said yoke pivot, whereby as said printing head moves toward the print position, said inking rollers are rapidly pivoted away from said actuating lever and out of the way of said printing head.

9. The label printing and applying mechanism of claim 8, wherein said first engagement element on said machine frame comprises a pin thereon and said second engagement element on said linkage means comprises a leg of said linkage means and means on that leg for engaging said pin on said frame.

10. The label printing and applying mechanism of claim 9, wherein said second guide further comprises an escape passage inclined downwardly in the direction of motion of said printing head toward the printing position and being inclined forwardly which is in the direction of motion of said second inking roller with said holder as said printing head is moving toward the print position and is in the direction in which said printing head first passes said second printing surface and thereafter passes said first printing surface, and the inclination of said escape passage is for enabling said second inking roller to move down more extensively than said first inking roller as said holding means moves forwardly through said frame, thereby also enabling said second inking roller to avoid contacting said first printing surface.

11. The label printing and applying mechanism of claim 9, wherein said holding means comprises a first holder to which said first inking roller is rotatably connected and a second holder to which said second inking roller is rotatably connected; said first and said second holders being pivotally connected to pivot with respect to each other and also to form an integrated assembly;

biasing means for urging one said holder to pivot with respect to the other said holder in one direction.

12. The label printing and applying mechanism of claim 11, wherein said inking rollers are removably attached on said holding means.

13. The label printing and applying mechanism of claim 1, wherein said holding means comprises a first holder to which said first inking roller is rotatably connected and a second holder to which said second inking roller is rotatably connected; said first and said second holders being pivotally connected to pivot with respect to each other and also to form a unitary assembly which moves together;

biasing means for urging one said holder to pivot with respect to the other said holder in one direction.

14. The label printing and applying mechanism of claim 1, further comprising a yoke attached to said actuating lever to be moved therewith; said actuating lever being pivotally attached to said frame and said yoke being pivotable therewith; said holding means being removably attached to said yoke.

15. The label printing and applying mechanism of claim 1, wherein said first and second guides comprise respective first and second passages in said frame and said guide engaging means of said first and said second inking rollers respectively comprise first and second guide roller means.

16. The label printing and applying mechanism of claim 15, wherein said first and second guide passages comprise respective first and second guide grooves cut into said machine frame; said first and said second guide roller means respectively engage in said first and said second guide grooves.

17. The label printing and applying mechanism of claim 16, wherein said frame has two opposite side surfaces and said first and second guide roller means are located at one said side surface of said frame said first guide groove is cut deeper into said frame at said one side surface thereof than said second guide groove; said guide roller means of said inking rollers are of a size to extend into the respective said guide grooves.

18. The label printing and applying machine of claim 17, wherein said frame comprises two opposed frame plates; each said frame plate respectively having said two opposite side surfaces and the respective said one side surfaces of said frame plates being opposed; said first and said second guide roller means respectively comprise a pair of guide rollers, and one of each said pair of rollers is located at each end of the respective said inking roller; said first and said second guide grooves being cut at opposed positions into both said one sides of said frame plates, said first guide grooves being cut deeper into said frame plate one sides than said second guide grooves; the space between said first guide rollers of said first inking roller being correspondingly larger than the space between said second guide rollers of said second inking rollers, thereby to be received in the respective said guide grooves.

19. The label printing and applying mechanism of claim 18, wherein said second guide further comprises an escape passage inclined downwardly in the direction of motion of said printing head toward the printing position and being inclined forwardly which is in the direction of motion of said second inking roller with said holder as said printing head is moving toward the print position and is in the direction in which said printing head first passes said second printing surface and thereafter passes said first printing surface and the inclination of said escape passage is for enabling said second inking roller to move down more extensively than said first inking roller as said holding means moves forwardly through said frame, thereby also enabling said second inking roller to avoid contacting said first printing surface.

* * * * *